US006114812A

United States Patent [19]

Lee

[11] Patent Number: 6,114,812

[45] Date of Patent: Sep. 5, 2000

[54] REMOTE CONTROL UNIT FOR INCANDESCENT LAMP

[75] Inventor: Jae Gu Lee, Bucheon-si, Rep. of Korea

[73] Assignee: KIJIN Electronics Co., Ltd., Kyunggi-do, Rep. of Korea

[21] Appl. No.: 09/241,226

[22] Filed: Feb. 1, 1999

[51] Int. Cl.[7] ..... H05B 37/02

[52] U.S. Cl. ..... 315/158; 315/156; 315/294

[58] Field of Search ..... 315/291, 292, 315/293, 294, 149, 156, 157, 158

[56] References Cited

U.S. PATENT DOCUMENTS 4,242,614 12/1980 Vatis et al. ..... 315/153

*Primary Examiner*—David H. Vu

*Attorney, Agent, or Firm*—Hickman Stephens Coleman & Hughes, LLP

[57] ABSTRACT

A remote control unit for an incandescent lamp for remotely controlling the incandescent lamp by using a remote controller. The remote control unit includes a remote controller for transmitting a remote control signal for controlling the lamp through the air, and a lamp controller. The lamp controller includes a rectifier, a sensor, a signal processor, a synchronizer, a pulse generator, a lamp connector and a signal input identifying portion. Since an on/off function of the lamp, extinction time reservation, a dimming function of various levels and the like can be performed by using the remote controller, a user s convenience can be facilitated in using the lamp.

12 Claims, 5 Drawing Sheets t0
t0'
t t1
t1'
t t2
t2'
t t3
t3'
t t4
t4'
t t5
t5'
t t6
t6'
t

REMOTE CONTROL UNIT FOR INCANDESCENT LAMP

BACKGROUND OF THE INVENTION

1. Field of the Invention

The present invention relates to a remote control unit for an incandescent lamp, and more particularly, to a unit for remotely controlling an incandescent lamp using a remote controller.

2. Description of the Related Art

In general, there is provided a power supply socket for supplying alternating current (AC) current for various home-use electric appliances on indoor walls of rooms, living room or kitchen, etc. In particular, in the house structure in which a separate lamp is necessary in every room, several lamps suitable for the respective room must be provided. Since the respective lamps operate independently, a user must move to the place where the lamp to be turned on or off is installed.

Also, even if there is provided a central control system for facilitating the control of the respective lamps, in order to control individual lamps, the user must move to the place where the central control system is installed.

SUMMARY OF THE INVENTION

To solve the above problems, it is an objective of the present invention to provide a remote control unit for incandescent lamps which can remotely control a lamp on/off function, an extinction time reservation function, a various-level dimming function and the like such that the remote control unit is installed on a power supply socket for installing incandescent lamps to then be connected to an AC power supply through itself.

Accordingly, to achieve the above objective, there is provided a remote control unit for an incandescent lamp comprising: a remote controller for transmitting a remote control signal for controlling the lamp to the air; and a lamp controller comprising: a rectifier for receiving external AC power and rectifying the same into DC power of a predetermined level; a sensor driven by the DC power supplied from the rectifier, for receiving the remote control signal; a signal processor driven by the DC power supplied from the rectifier, for receiving and analyzing the remote control signal from the sensor and generating a lamp control signal indicative of the current state of the lamp; a synchronizer for receiving the AC power and generating a synchronization signal indicative of a starting point of the waveform of the AC power; a pulse generator driven by the DC power supplied from the rectifier, for generating pulse streams for limiting the current applied to the lamp in accordance with the lamp control signal supplied from the signal processor on the basis of the synchronization signal; and a lamp connector connected to the AC power through the lamp, for controlling the current to flow the lamp for every half cycle of the waveform of the AC power after the timing at which pulses are generated by the pulse generator.

Here, the signal processor is constructed to be equipped with various functions including a function of generating a lamp-off signal as the lamp control signal when the remote control signal applied through the sensor is a lamp on/off signal and the lamp is on, and generating a lamp-on signal as the lamp control signal when the remote control signal is a lamp on/off signal and the lamp is off; a function of generating a lamp-off signal as the lamp control signal after a predetermined time when the remote control signal is a lamp extinction reservation signal; a function of generating a dimming-up signal as the lamp control signal when the remote control signal is the dimming-up signal and the current states of the lamp are in dimming levels other than the highest dimming level; and a function of generating a dimming-down signal as the lamp control signal when the remote control signal is the dimming-down signal and the current states of the lamp are in dimming levels other than the lowest dimming level. Also, the signal processor is further equipped with a function of generating a predetermined identification signal indicative of the input of the remote control signal when it is applied through the sensor.

The remote control unit for incandescent lamp further comprises a signal input identifying portion having either a buzzer which makes a buzzer sound or a light emitting diode (LED) which emits light according to the identification signal or having both the buzzer and the LED.

According to a preferred embodiment of the present invention, the pulse generator generates pulses for every half cycle from the starting point of the AC power when the lamp control signal is a lamp-on signal, generates no pulse when the lamp control signal is a lamp-off signal, generates pulse streams produced such that the respective pulses of the pulse stream being currently generated are delayed by a value obtained by dividing a half cycle of the AC power by the total number of dimming levels when the lamp control signal is a dimming-up signal, and generates pulse streams produced such that the respective pulses of the pulse stream being currently generated precede by a value obtained by dividing a half cycle of the AC power by the total number of dimming levels when the lamp control signal is a dimming-down signal.

Also, the pulse generator is further equipped with a function of returning the lamp control signal received from the signal processor back to the signal processor, and the signal processor compares the lamp control signal returning from the pulse generator with the lamp control signal transmitted to the pulse generator by itself, checks whether the pulse generator has received a proper signal and transmits the proper lamp control signal again to the pulse generator if the pulse generator has received a wrong signal.

More preferably, the signal processor and the pulse generator are constructed by a programmable IC element, respectively.

According to a preferred embodiment of the present invention, the synchronizer comprises: a first diode for rectifying AC power applied to its anode; a first and a second resistors serially connected to a cathode of the first diode, for dividing a cathode voltage of the first diode by a predetermined ratio; a second diode for clamping the divided voltage into a voltage usable in the pulse generator by its Zener voltage; and a third resistor for limiting the current flowing by the clamped voltage and transmitting the limited current as the synchronization signal to the pulse generator.

Also, the lamp connector comprises a first capacitor which receives the pulse streams generated from the pulse generator; a first resistor for limiting the current between an output port of the first capacitor and a ground port; a triac element whose anode is connected to the lamp and whose cathode is grounded, and which receives the output of the first capacitor as a control signal; and a second capacitor and a second resistor serially connected to both ends of the triac element, for preventing surge.

The lamp controller may be installed by being inserted into an external AC power supply terminal and may comprise a means into which a power supply plug of the lamp to be remotely controlled can be inserted.

The remote controller is equipped with a function of generating as a remote control signal a lamp on/off signal for turning on/off the lamp, an extinction reservation signal for turning the lamp off automatically after a predetermined time, a dimming-up signal and a dimming-down signal.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENTS

The present invention will now be described in detail with reference to the accompanying drawings.

Figure 1:
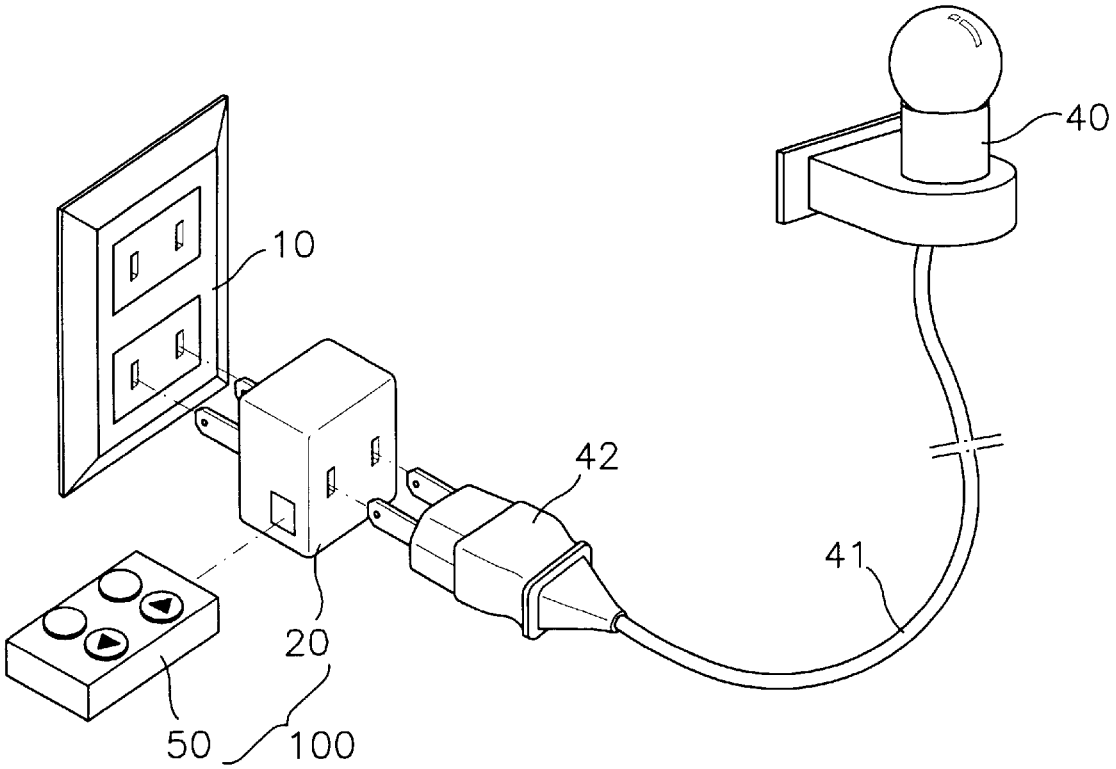
FIG. 1 is a diagram illustrating the states in which a remote control unit for incandescent electric lamp according to the present invention is used.

FIG. 1 illustrates the state in which a remote control unit 100 for incandescent lamps according to the present invention is used, in which a lamp controller 20 is installed in an alternative current (AC) power supply terminal for supplying AC power indoors, such as a wall socket 10, and a power plug 42 provided in a power line 41 of a lamp 40 is inserted into the lamp controller 20.

Thus, prior to lamp installation, a user inserts the lamp controller 20 into the AC power supply terminal, e.g., a wall socket 10, in which the lamp 40 is to be installed, connects the power plug 42 of the lamp 40 to the installed lamp controller 20 and then remotely controls the lamp 40 using a remote controller 50.

Figure 2:
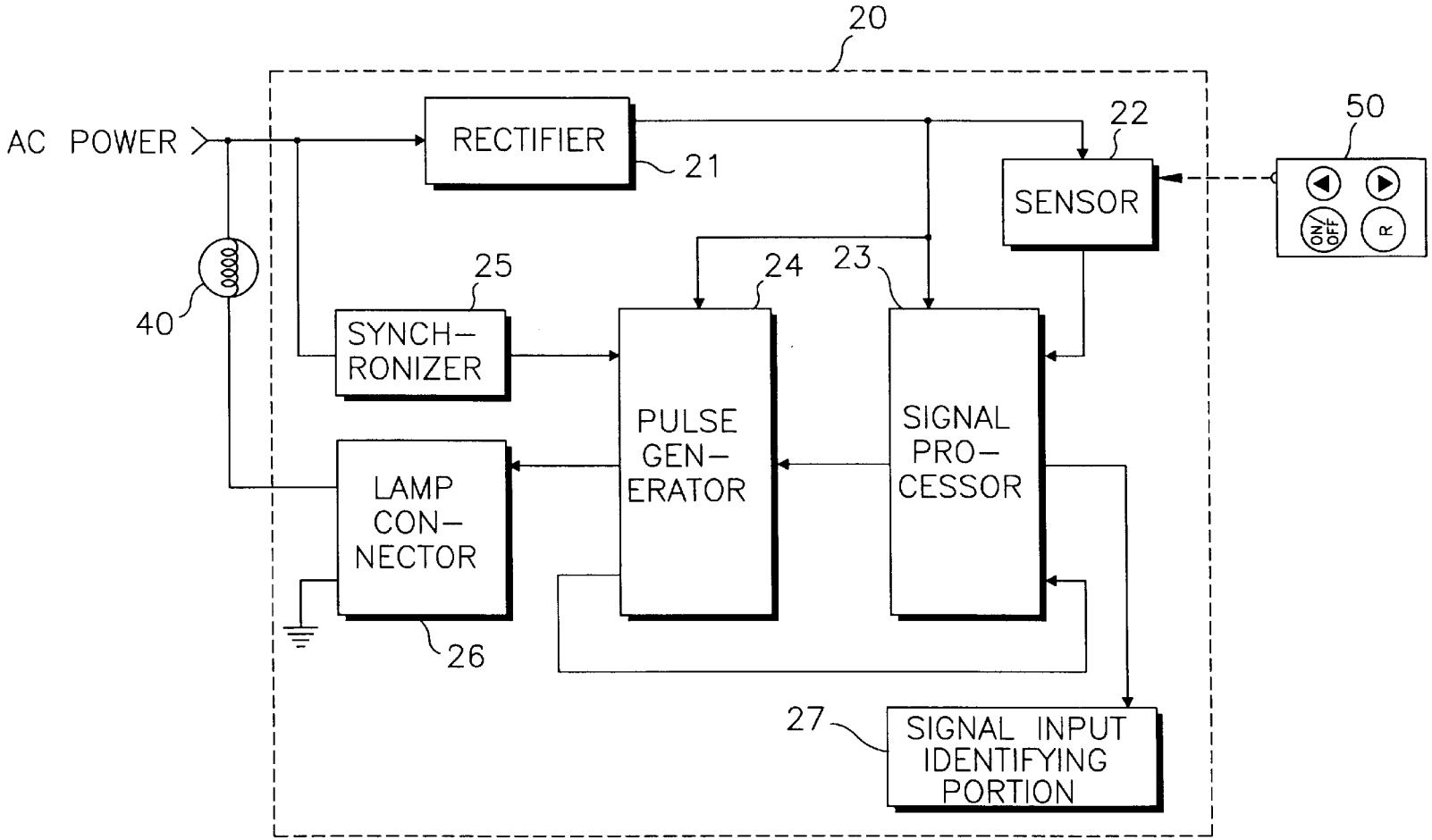
FIG. 2 is a block diagram of a remote control unit for incandescent electric lamp according to the present invention.

FIG. 2 is a block diagram of the lamp controller 20 of the remote control unit 100 for incandescent lamps according to an embodiment of the present invention, which includes a rectifier 21, a sensor 22, a signal processor 23, a pulse generator 24, a synchronizer 25, a lamp connector 26 and a signal input identifying portion 27. The lamp controller 20 is controlled by the remote controller 50 spaced apart from the lamp controller 20 by a predetermined distance and used for transmitting a remote control signal thereto.

The operating principle of the lamp controller 20 will now be described briefly. The rectifier 21 rectifies an AC power into a direct current (DC) power, i.e., IC driving power, and outputs the DC power. The DC power is power to be supplied to the elements implemented by an IC among various elements of the present invention.

When a user operates the remote controller 50 to generate signals for on/off, dimming or extinction of the lamp 40, the signals are transmitted to the sensor 22 wirelessly. The sensor 22 detects the signals and transmits the same to the signal processor 23. The signal processor 23 analyzes signals detected and transmitted from the sensor 22 and supplies a signal indicative of the state of the lamp 40 to the pulse generator 24. The pulse generator 24 generates pulses for on/off, dimming or extinction of the lamp 40 on the basis of a synchronizing signal transmitted from the synchronizer 25.

Then, the lamp connector 26 allows the AC power (a sine or cosine signal) necessary for on/off, dimming or extinction of the lamp 40 to be applied to the lamp 40 using the pulses generated from the pulse generator 24 so that the state of the lamp 40 is controlled.

Now, various elements of the lamp controller 20 will be described in more detail.

First, the rectifier 21 receives AC power from the AC power supply terminal such as a wall socket 10, rectifies the received AC power into DC power for driving ICs and outputs the DC power, which supplies power for driving various elements implemented by ICs, such as the sensor 22, the input signal identifying portion 27, the signal processor 23 or the pulse generator 24.

Since ICs are generally driven by DC power of +5 volts, the IC driving power supplied from the rectifier 21 is 5 volts of a DC level. It is widely known a method and system for converting AC power of a predetermined magnitude into DC power. Thus, the DC power is not restricted to a specific level but any DC power level that is suitable for ICs used for construction of the present invention can be adopted.

The sensor 22 receives a remote control signal for controlling the lamp 40, which is transmitted from the remote controller 50 spaced apart from the lamp controller 20 by a predetermined distance. The sensor 22 is preferably constructed so as to receive an infrared ray signal supplied from an infrared ray remote controller, but is not restricted thereto. That is to say, the sensor 22 is a means for receiving a signal transmitted from the wireless remote controller 50 through the air.

Now, the remote controller 50 of the remote control unit 100 for incandescent lamps will be described in more detail.

The remote controller 50 outputs a lamp on/off signal, an extinction reservation signal and a signal for adjusting brightness of the lamp 40, i.e., a dimming signal. In the case when the remote controller 50 is an infrared type, to avoid confusion with electrical appliances being currently in wide use such as television sets, audio sets and the like which employ infrared remote controllers, the remote controller 50 outputs an identification signal before generating the infrared signal for performing the above-mentioned functions.

Figure 3:
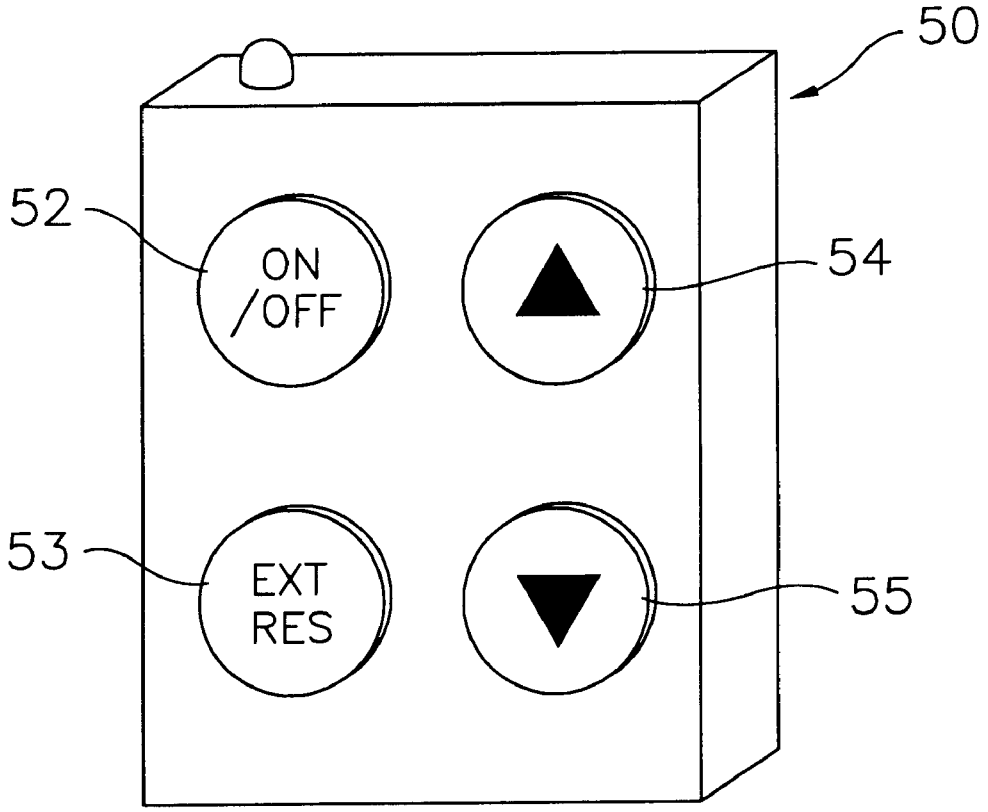
FIG. 3 is a diagram illustrating the outer appearance of a remote controller.

FIG. 3 is a diagram illustrating the outer appearance of a remote controller 50, which includes a lamp on/off button 52, an extinction reservation button 53 and dimming level setting buttons, that is, a dimming-up button 54 and a dimming-down button 55.

The lamp on/off button 52 generates a lamp on/off signal for turning on or off the lamp 40. The extinction reservation button 53 is used for reserving extinction time when a user would be asleep in a predetermined time or the lamp 40 is intended to be put off in a predetermined time after the user is out.

The dimming level setting buttons are used for adjusting the brightness of the lamp 40 and include the dimming-up button 54 and the dimming-down button 55. The dimming-up button 54 generates a dimming-up signal which increases a dimming level one by one whenever it is pressed. The dimming-down button 55 generates a dimming-down signal which decreases a dimming level one by one whenever it is pressed.

The sensor 22 receives a signal transmitted serially from the remote controller 50 through the air.

The remote controller 50 according to the embodiment shown in FIG. 3 receives remote control signals including a lamp on/off signal, an extinction reservation signal, a dimming-up signal, a dimming-down signal and an identification signal and supplies the received signal to the signal processor 23. As described above, the driving power of the sensor 22 is supplied from the rectifier 21.

The signal processor 23 receives and analyzes the remote control signals received from the sensor 22 and transmits a lamp control signal indicative of the state of the lamp 40 to the pulse generator 24. In other words, the signal received from the sensor 22 and the current input signal indicative of the state of the lamp 40 are compared and then the necessary lamp control signal is transmitted to the pulse generator 24. Examples of the lamp control signal for the remote controller 50 according to the embodiment shown in FIG. 3 are shown in the following Table 1.

TABLE 1

| Current input remote control signal | Current state of lamp | Lamp control signal |
|---|---|---|
| Lamp on/off signal | On | Lamp off signal |
| Lamp on/off signal | Off | Lamp on signal |
| Extinction reservation signal | On | Lamp off signal after a reservation time |
| Extinction reservation signal | Off | Negligible |
| Dimming-up signal | Highest dimming level | Negligible |
| Dimming-up signal | Other than highest dimming level | Dimming-up signal |
| Dimming-down signal | Lowest dimming level | Negligible |
| Dimming-down signal | Other than lowest dimming level | Dimming-down signal |

Here, the dimming-up signal or the dimming-down signal shown in Table 1 is based on the assumption that the lamp 40 is currently turned on.

As shown in Table 1, when the lamp 40 is currently being in an ON state and the lamp on/off signal is received, a signal which turns the lamp 40 off is supplied as the lamp control signal. When the lamp 40 is currently being in an OFF state and the lamp on/off signal is received, a signal which turns the lamp 40 on is supplied as the lamp control signal.

Also, when the lamp 40 is currently being in an ON state and the extinction reservation signal is received, a lamp off signal is supplied as the lamp control signal when a predetermined time is elapsed after the lamp off signal is received. Thus, the signal processor 23 must include a means for counting time, preferably a timer for counting a real time. Here, preferably, the signal processor 23 is implemented using a programmable IC, thereby facilitating a change in extinction time in the case of manufacturing the products.

When a dimming-up signal is received, the dimming-up signal is supplied as the lamp control signal. When a dimming-down signal is received, the dimming-down signal is supplied as the lamp control signal. Here, the dimming levels take various levels to conform with the user's request. When the current dimming level is lowest and the dimming-down signal is received or when the current dimming level is highest and the dimming-up signal is received, the current dimming level is retained without change. In other words, the current input remote control signal is negligible.

Now, for the sake of convenience of explanation, it is assumed that the dimming levels are seven levels from the brightest level, that is, a level 1, to the darkest level, that is, a level 7, in the present invention. However, the dimming levels of the remote control unit 100 for incandescent lamps according to the present invention are not limited to seven levels.

The pulse generator 24 generates continuously pulses used for adjusting the power applied to the lamp 40 in accordance with the lamp control signal transmitted from the signal processor 23 and supplies the same to the lamp connector 26. In other words, the pulses generated from the pulse generator 24 indicate timing at which waveforms of AC power are applied to the lamp 40 for every half cycle. Here, the pulses are generated based on a synchronization signal received from the synchronizer 25.

Figures 4A, 4B, 4C, 4D, 4E, 4F, 4G:
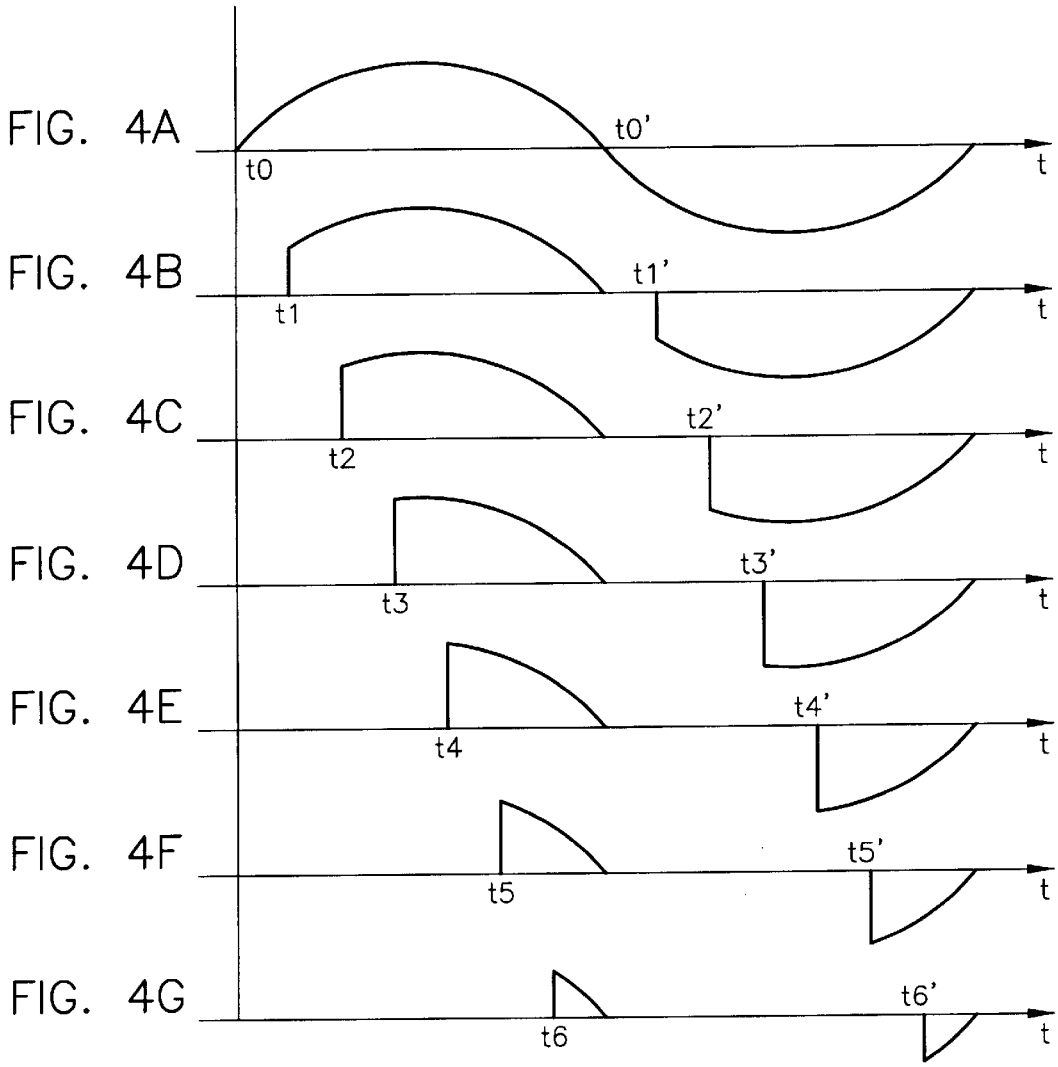
FIGS. 4A through 4G are waveform diagrams of AC power applied to a lamp in accordance with dimming levels.

FIGS. 4A through 4G are waveform diagrams of AC power applied to the lamp 40 in accordance with dimming levels, in which FIG. 4A is a waveform diagram of AC power in the lowest dimming level, i.e., the dimming level 1, that is, in the case when the lamp 40 is simply turned on, FIGS. 4B through 4G are waveform diagrams of AC power in the respective dimming levels, i.e., the dimming levels 2 through 7, in which the higher the dimming level is and the darker the lamp 40 is as the AC power applied to the lamp 40 is more encroached.

Here, the waveforms of the AC power for the respective dimming levels shown in FIGS. 4A through 4G are made by way of example only such that the widths of the encroached portions of the waveforms are equal to one another and can be arbitrarily set in accordance with the respective dimming levels in the case that a programmable IC is used.

Referring to FIGS. 4A through 4G, the timings at which the pulses for the dimming level 1 are generated from the pulse generator 24 are t0 and t0', the timings at which the pulses for the dimming level 2 are generated from the pulse generator 24 are t1 and t1', the timings at which the pulses for the dimming level 3 are generated from the pulse generator 24 are t2 and t2', the timings at which the pulses for the dimming level 4 are generated from the pulse generator 24 are t3 and t3', the timings at which the pulses for the dimming level 5 are generated from the pulse generator 24 are t4 and t4', the timings at which the pulses for the dimming level 6 are generated from the pulse generator 24 are t5 and t5', and the timings at which the pulses for the dimming level 7 are generated from the pulse generator 24 are t6 and t6'.

Here, when the lamp 40 is an OFF state, no pulse is generated. When the lamp 40 is simply turned on, the same pulse streams as those of the dimming level 1 are generated.

More preferably, the pulse generator 24 is equipped with a function of returning the lamp control signal received from the signal processor 23 to the signal processor 23. Here, the signal processor 23 compares the lamp control signal supplied from the pulse generator 24 with that transmitted by itself to the pulse generator 24 to check whether the pulse generator 24 has received a proper signal. Then, if the pulse generator 24 has received a wrong signal, the signal processor 23 transmits the proper signal to the pulse generator 24.

In order for the pulse generator 24 to regularly generate pulses for dimming, a starting point of the AC power applied to the lamp controller 20 according to the present invention, e.g., a point at which the phase of the waveform of the AC power is zero, must be known, which is informed by the synchronizer 25. That is to say, the synchronizer 25 generates a signal indicative of a starting point of the AC power applied to the lamp controller 20 and supplies the same to the pulse generator 24.

Figure 5:
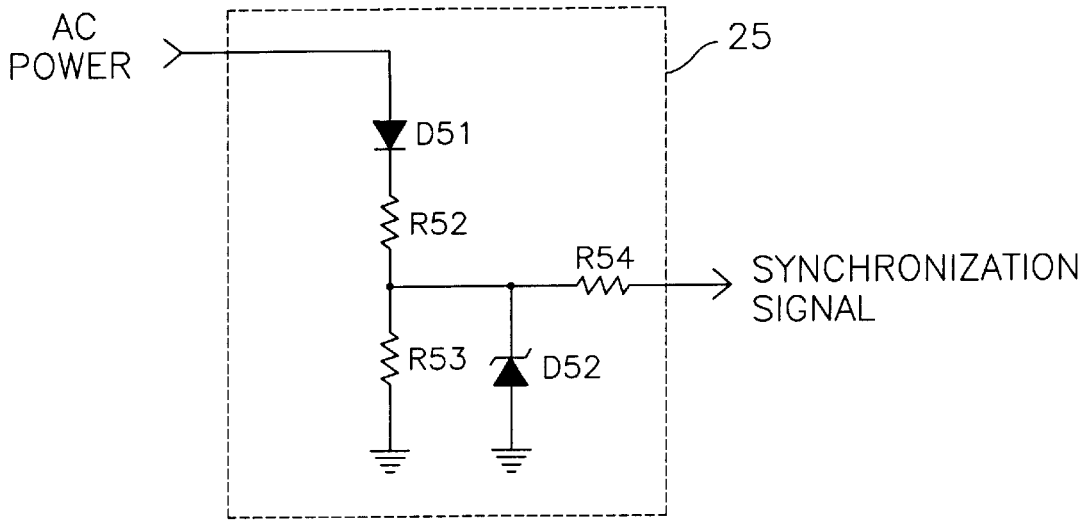
FIG. 5 is a schematic diagram illustrating an embodiment of a synchronizer in FIG. 2.

FIG. 5 is a schematic diagram illustrating an embodiment of the synchronizer 25, which includes a first diode D51 which receives and rectifies AC power to its anode, a first resistor R52 connected to a cathode of the first diode D51, a second resistor R53 serially connected to the first resistor R52 to then be grounded, a second diode D52 positioned between a joint point of the first and second resistors R52 and R53 and a ground port, and a third resistor R54 whose first end is connected to a joint point of the first and second resistors R52 and R53 and whose second end is connected to an input port of the synchronization signal of the pulse generator 24.

In detail, the AC power half-wave rectified by the first diode D51 is divided by the first and second resistors R52 and R53. The voltage applied to the second resistor R53 is clamped into a voltage level used in the pulse generator 24 by the second diode D52. In other words, the voltage applied to the third resistor R54 takes the waveform of the half-wave AC power applied to the second resistor R53 at a voltage lower than the Zener voltage of the second diode D52 and takes the waveform fixed to the Zener voltage, e.g. 5 volts, at a voltage higher than the Zener voltage thereof. The third resistor R54 limits the current flowing due to the voltages of applying such waveforms to transmit the limited current to the input port of the synchronization signal of the pulse generator 24. The pulse generator 24 detects this signal to recognize the starting point of the waveform of the AC power.

The lamp connector 26 receives the pulses generated from the pulse generator 24 and allows the power having the waveforms shown in FIGS. 4A through 4G to be supplied to the lamp 40. The lamp 40 is connected between the AC power applied to the lamp controller 20 and the output port of the lamp connector 26.

The lamp connector 26 will now be described in more detail. The current is controlled to flow through the lamp 40 only during a period ranging from a timing at which pulses are generated from the pulse generator 24 to a timing at which the value of the AC power is less than a sustaining current value of a triac element T61 of FIG. 6 and the current is controlled not to flow through the lamp 40 during the other period, thereby applying the power having the waveforms shown in FIGS. 4A through 4G to both ends of the lamp 40.

Figure 6:
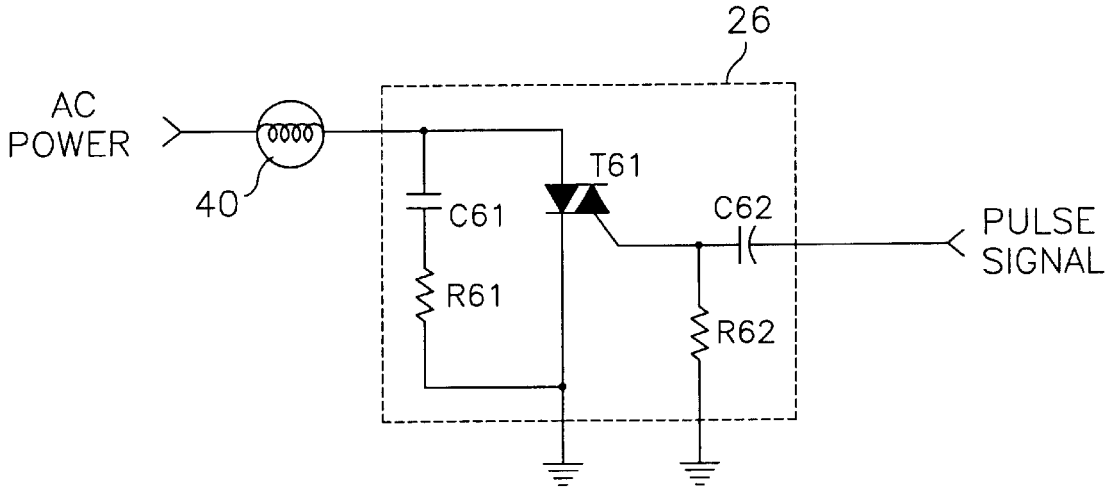
FIG. 6 is a schematic diagram illustrating an embodiment of a lamp connector in FIG. 2.

FIG. 6 is a schematic diagram of the lamp connector 26 according to a preferred embodiment of the present invention, in which the AC power applied to the lamp 40 is changed using the triac element T61.

In other words, periodical pulse signals are continuously applied to a gate port as a control signal of the triac element T61 through a capacitor C62 connected to a pulse output port of the pulse generator 24 and a current limiting resistor R62 parallel-connected to the capacitor C62 and grounded. Also, an anode of the triac element T61 is an output port of the lamp connector 26 and is connected to one end of the lamp 40. A cathode of the triac element T61 is grounded and a gate thereof is connected to an output port of the capacitor C62.

Here, since the triac element T61 is turned on at a timing at which pulses are applied to its gate port, the AC current flows through the lamp 40. However, even once the triac element T61 is turned on, if the anode current of the triac element T61 is less than a predetermined sustaining current value, the triac element T61 is turned off, which disables the current to flow through the lamp 40. Thus, the current flowing the lamp 40 takes the waveforms shown in FIGS. 4A through 4G.

Here, the capacitor C62 and the resistor R61 used for preventing surge eliminate the surge occurring at the output port of the triac element T61.

In order to implement the present invention more preferably, it is necessary to notify a user of transmission of a remote control signal to the lamp controller 20 when the user manipulates the remote controller 50. To this end, if the remote control signal is transmitted to the lamp controller 20, there is provided the signal input identifying portion 27 for notifying the user of the transmission of the remote control signal by emitting light or making a buzzer sound.

According to a preferred embodiment of constructing the signal input identifying portion 27, if the remote control signal is received from the signal processor 23 through the sensor 22, a identification signal is transmitted to the signal input identifying portion 27, which may be constructed by a light emitting diode (LED) or a buzzer operating when the identification signal is received, or may be constructed by both.

Here, the LED and the buzzer constructing the signal input identifying portion 27 are used by way of example only for explaining the function of the signal input identifying portion 27 but are not limited thereto. The signal input identifying portion 27 implies any means by which the user can recognize that the remote control signal has been input to the lamp controller 20. Also, the incandescent lamp used as the lamp 40 may include a halogen lamp.

According to the present invention, since an on/off function of the lamp, extinction time reservation, a dimming function of various levels and the like can be performed by using the remote controller, a user's convenience can be facilitated in using the lamp.

While this invention has been described in connection with what is presently considered to be the most practical and preferred embodiments, it is to be understood that the invention is not limited to the disclosed embodiment, but, on the contrary, it is intended to cover various modifications and equivalent arrangements included within the spirit and scope of the appended claims.

What is claimed is:

1. A remote control unit for an incandescent lamp comprising:

a remote controller for transmitting a remote control signal for controlling the lamp through the air; and a lamp controller comprising:

a rectifier for receiving an external AC power and rectifying the same into DC power of a predetermined level;

a sensor driven by the DC power supplied from the rectifier, for receiving the remote control signal;

a signal processor driven by the DC power supplied from the rectifier, for receiving and analyzing the remote control signal from the sensor and generating a lamp control signal indicative of the current state of the lamp;

a synchronizer for receiving the AC power and generating a synchronization signal indicative of a starting point of the waveform of the AC power;

a pulse generator driven by the DC power supplied from the rectifier, for generating pulse streams for limiting the current applied to the lamp in accordance with the lamp control signal supplied from the signal processor on the basis of the synchronization signal; and a lamp connector connected to the AC power through the lamp, for controlling the current flowing through the lamp for every half cycle of the waveform of the AC power after the timing at which pulses are generated by the pulse generator.

2. The remote control unit according to claim 1, wherein the signal processor is constructed to be equipped with various functions including a function of generating a lamp-off signal as the lamp control signal when the remote control signal applied through the sensor is a lamp on/off signal and the lamp is on, and generating a lamp-on signal as the lamp control signal when the remote control signal is a lamp on/off signal and the lamp is off; a function of generating a lamp-off signal as the lamp control signal after a predetermined time when the remote control signal is a lamp extinction reservation signal; a function of generating a dimming-up signal as the lamp control signal when the remote control signal is the dimming-up signal and the current states of the lamp are in dimming levels other than the highest dimming level; and a function of generating a dimming-down signal as the lamp control signal when the remote control signal is the dimming-down signal and the current states of the lamp are in dimming levels other than the lowest dimming level.

3. The remote control unit according to claim 2, wherein the signal processor is further equipped with a function of generating a predetermined identification signal indicative of the input of the remote control signal when it is applied through the sensor thereto.

4. The remote control unit according to claim 3, further comprising:

a signal input identifying portion having either a buzzer which makes a buzzer sound or a light emitting diode (LED) which emits light or having both the buzzer and the LED.

5. The remote control unit according to claim 1, wherein the pulse generator generates pulses for every half cycle from the starting point of the AC power when the lamp control signal is a lamp-on signal, generates no pulse when the lamp control signal is a lamp-off signal, generates pulse streams produced such that the respective pulses of the pulse stream being currently generated are delayed by a value obtained by dividing a half cycle of the AC power by the total number of dimming levels when the lamp control signal is a dimming-up signal, and generates pulse streams produced such that the respective pulses of the pulse stream being currently generated precede by a value obtained by dividing a half cycle of the AC power by the total number of dimming levels when the lamp control signal is a dimming-down signal.

6. The remote control unit according to claim 5, wherein the pulse generator returns the lamp control signal received from the signal processor to the signal processor.

7. The remote control unit according to claim 6, wherein the signal processor compares the lamp control signal returning from the pulse generator with the lamp control signal transmitted to the pulse generator by itself, checks whether the pulse generator has received a proper signal and transmits the proper lamp control signal again to the pulse generator if the pulse generator has received a wrong signal.

8. The remote control unit according to claim 1, wherein the signal processor and the pulse generator are constructed by a programmable IC element, respectively.

9. The remote control unit according to claim 1, wherein the synchronizer comprises:

a first diode which receives and rectifies AC power to its anode;

first and second resistors serially connected to a cathode of the first diode, for dividing a cathode voltage of the first diode by a predetermined ratio;

a second diode for clamping the divided voltage into a voltage usable in the pulse generator by its Zener voltage; and a third resistor for limiting the current flowing by the clamped voltage and transmitting the limited current as the synchronization signal to the pulse generator.

10. The remote control unit according to claim 1, wherein the lamp connector comprises:

a first capacitor which receives the pulse streams generated from the pulse generator;

a first resistor for limiting the current between an output port of the first capacitor and a ground port;

a triac element whose anode is connected to the lamp and whose cathode is grounded, and which receives the output of the first capacitor as a control signal through its gate; and a second capacitor and a second resistor serially connected to both ends of the triac element, for preventing surge.

11. The remote control unit according to claim 1, wherein the lamp controller is installed by being inserted into an external AC power supply terminal and comprises a means into which a power supply plug of the lamp to be remotely controlled can be inserted.

12. The remote control unit according to claim 1, wherein the remote controller is equipped with a function of generating as a remote control signal a lamp on/off signal for turning on/off the lamp, an extinction reservation signal for turning the lamp off automatically after a predetermined time, a dimming-up signal and a dimming-down signal.

* * * * *